US007471043B2

(12) United States Patent
Kim

(10) Patent No.: US 7,471,043 B2
(45) Date of Patent: Dec. 30, 2008

(54) AC DISCHARGE DISPLAY PANEL INCLUDING A PLURALITY OF ELECTRODE LINES HAVING MULTI-LAYERS

(75) Inventor: Dong-Hyun Kim, Suwon-si (KR)

(73) Assignee: Samsung SDI Co., Ltd., Suwon (KR)

( * ) Notice: Subject to any disclaimer, the term of this patent is extended or adjusted under 35 U.S.C. 154(b) by 404 days.

(21) Appl. No.: 11/419,255

(22) Filed: May 19, 2006

(65) Prior Publication Data

US 2006/0290300 A1 Dec. 28, 2006

(30) Foreign Application Priority Data

Jun. 25, 2005 (KR) ..... 10-2005-0055412

(51) Int. Cl.
*H01J 17/04* (2006.01)

(52) U.S. Cl. ..... 313/582; 313/581; 313/587

(58) Field of Classification Search ..... 313/581–587; 315/169.3; 345/37, 41, 60
See application file for complete search history.

(56) References Cited

U.S. PATENT DOCUMENTS

| | | | | |
|---|---|---|---|---|
| 5,541,618 | A | 7/1996 | Shinoda | |
| 6,657,396 | B2 * | 12/2003 | Nakada et al. | 315/169.1 |
| 6,864,630 | B2 * | 3/2005 | Fujiwara | 313/584 |
| 6,900,591 | B2 | 5/2005 | Huang et al. | |
| 6,998,781 | B2 * | 2/2006 | Kimura et al. | 313/582 |
| 7,116,047 | B2 * | 10/2006 | Kim et al. | 313/584 |

* cited by examiner

*Primary Examiner*—Ashok Patel
(74) *Attorney, Agent, or Firm*—H.C. Park & Associates, PLC

(57) ABSTRACT

An alternating current discharge display panel including a plurality of electrode lines in a dielectric layer, and each of the electrode lines includes a plurality of layers, in which an intermediate layer has the smallest resistivity and resistivity of other layers become larger as being far from the intermediate layer.

17 Claims, 4 Drawing Sheets

AC DISCHARGE DISPLAY PANEL INCLUDING A PLURALITY OF ELECTRODE LINES HAVING MULTI-LAYERS

CROSS-REFERENCE TO RELATED APPLICATIONS

This application claims priority to and the benefit of Korean Patent Application No. 10-2005-0055412, filed on Jun. 25, 2005, which is hereby incorporated by reference for all purposes as if fully set forth herein.

BACKGROUND OF THE INVENTION

1. Field of the Invention

The present invention relates to a discharge display panel, and more particularly, to an alternating current (AC) discharge display panel including electrode lines covered by a dielectric layer.

2. Description of the Related Art

Generally, an AC discharge display panel, such as the plasma display panel disclosed in U.S. Pat. No. 6,900,591, includes electrode lines covered by a dielectric layer. U.S. Pat. No. 5,541,618 discloses a method of driving an AC discharge display panel.

Each electrode line may be formed by combining a transparent electrode line and an opaque electrode line, or may be formed of an opaque electrode line. Indium-tin-oxide (ITO) is often used for the transparent electrode line. The opaque electrode line, which has a lower resistance and a lower coupling capacity than those of the transparent electrode line, is generally a metal electrode line.

When fabricating an AC discharge display panel, metal particles of the opaque electrode line may diffuse and migrate into the dielectric layer during heat treatment of the plasma display panel.

Therefore, the conductivity of the dielectric layer increases, which may cause dielectric breakdown. Additionally, if the conductivity of the dielectric layer increases, the AC discharge display panel's performance may degrade. Also, discoloration of the discharge display panel and diffusion of light may degrade the panel's optical performance.

SUMMARY OF THE INVENTION

The present invention provides an AC discharge display panel including electrode lines covered by a dielectric layer that may prevent conductive particles of the electrode lines from diffusing and migrating into a glass substrate and the dielectric layer.

Additional features of the invention will be set forth in the description which follows, and in part will be apparent from the description, or may be learned by practice of the invention.

The present invention discloses an AC discharge display panel including a plurality of electrode lines covered by a dielectric layer. Each electrode line includes a plurality of layers, in which an intermediate layer has the smallest resistivity and the remaining layers have increasing resistivity in a direction away from the intermediate layer.

The present invention also discloses an AC discharge display panel including pairs of X electrode lines and Y electrode lines covered by a first dielectric layer adjacent to a first substrate, and address electrode lines covered by a second dielectric layer adjacent to a second substrate. The X electrode lines and the Y electrode lines each include a plurality of layers, the intermediate layer has the smallest resistivity of the plurality of layers, and the remaining layers have increasing resistivity in a direction away from the intermediate layer.

The present invention also discloses an AC discharge display panel including a plurality of electrode lines protected by a dielectric layer, and each of the electrode lines has a plurality of layers including an intermediate layer, a first outermost layer, and a second outermost layer. The intermediate layer has the smallest resistivity of the plurality of layers, and the first outermost layer and the second outermost layer have the highest resistivity of the plurality of layers.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention, and together with the description serve to explain the principles of the invention.

DETAILED DESCRIPTION OF THE ILLUSTRATED EMBODIMENTS

Figure 1:
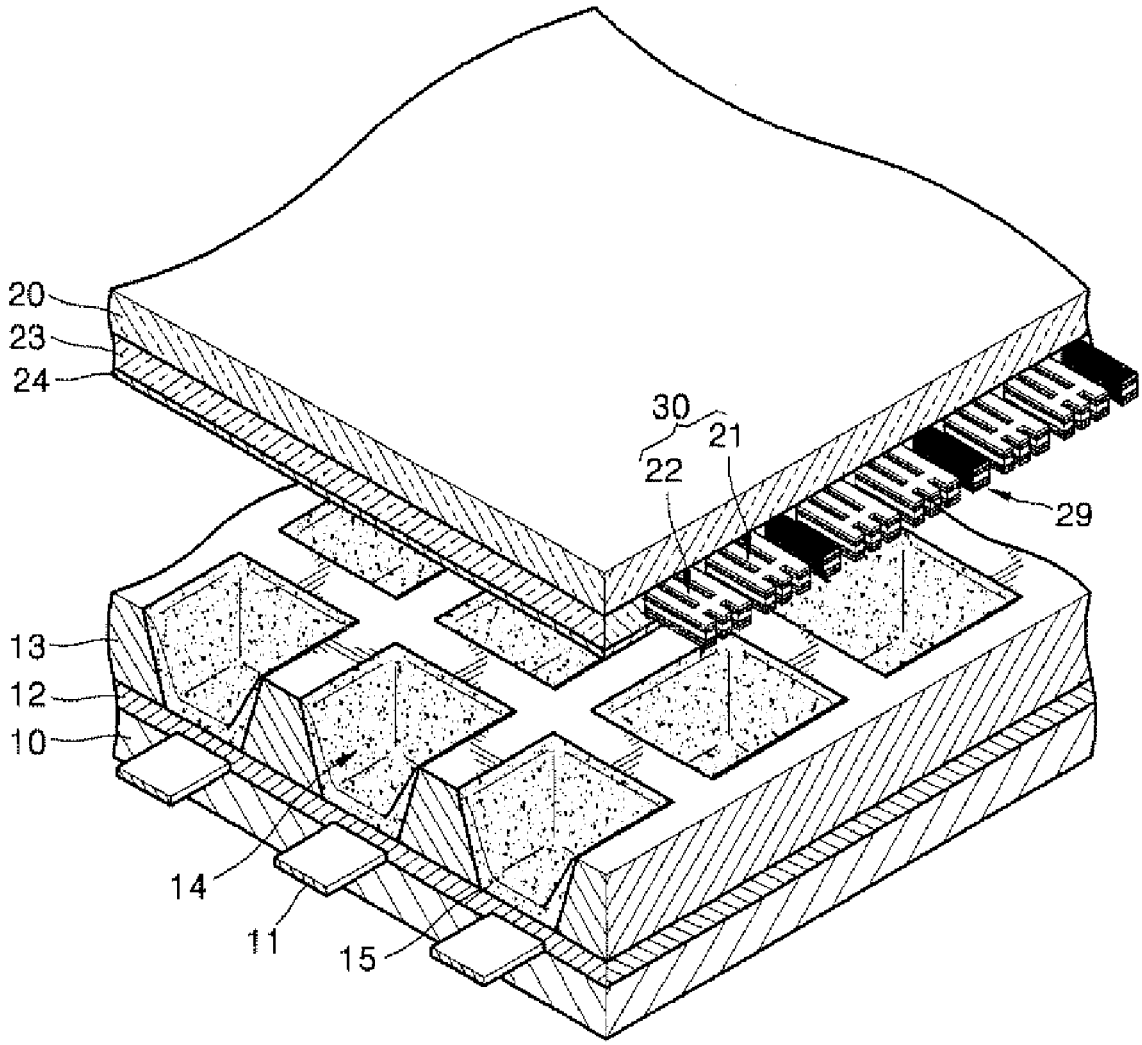
FIG. 1 is an exploded perspective view of a three-electrode surface discharge plasma display panel, as an example of an AC discharge display panel according to an exemplary embodiment of the present invention.

The invention is described more fully hereinafter with reference to the accompanying drawings, in which embodiments of the invention are shown. This invention may, however, be embodied in many different forms and should not be construed as limited to the embodiments set forth herein. Rather, these embodiments are provided so that this disclosure is thorough, and will fully convey the scope of the invention to those skilled in the art. In the drawings, the size and relative sizes of layers and regions may be exaggerated for clarity. Like reference numerals in the drawings denote like elements.

It will be understood that when an element such as a layer, film, region or substrate is referred to as being "on" another element, it can be directly on the other element or intervening elements may also be present. In contrast, when an element is referred to as being "directly on" another element, there are no intervening elements present.

Figure 2:
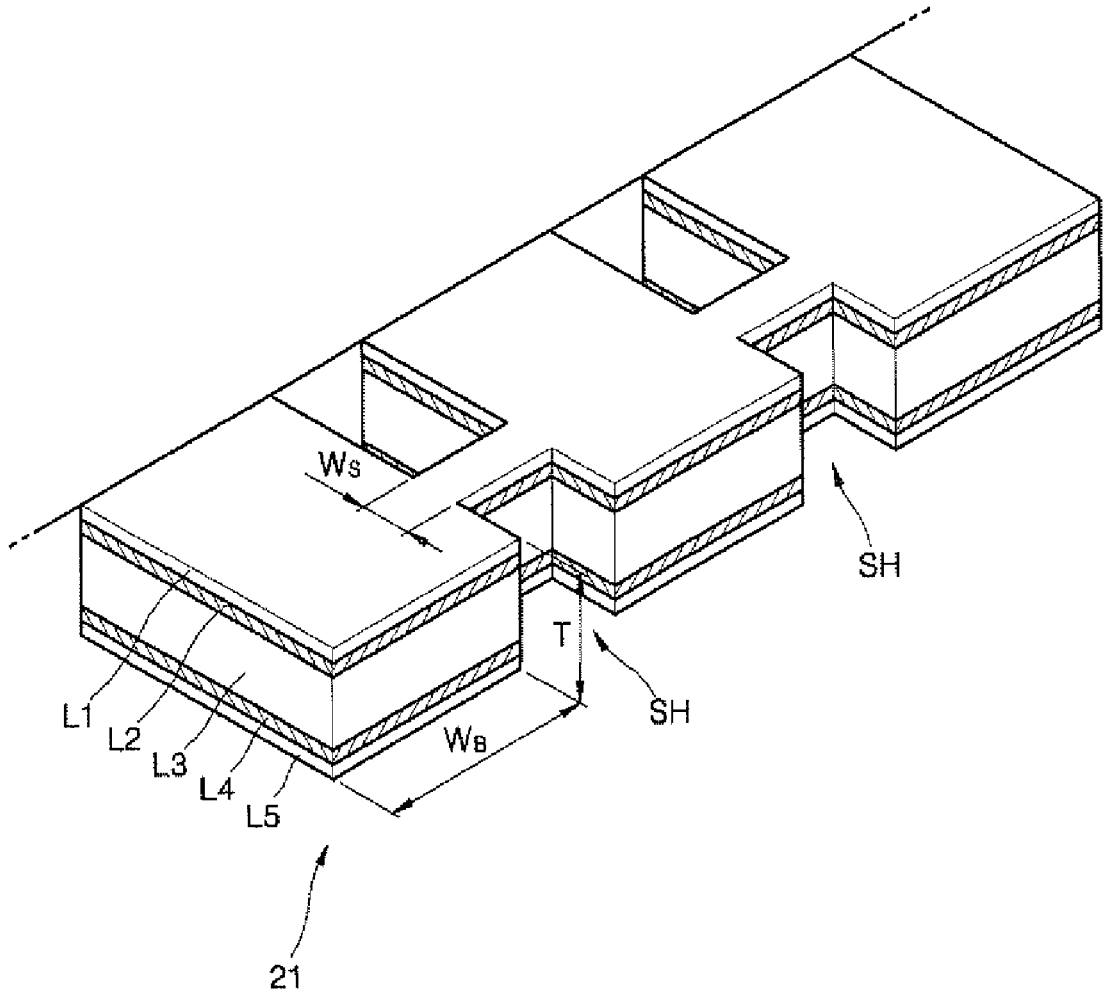
FIG. 2 is an enlarged view of a part of an X electrode line or a Y electrode line in the AC plasma display panel of FIG. 1.
Figure 3:
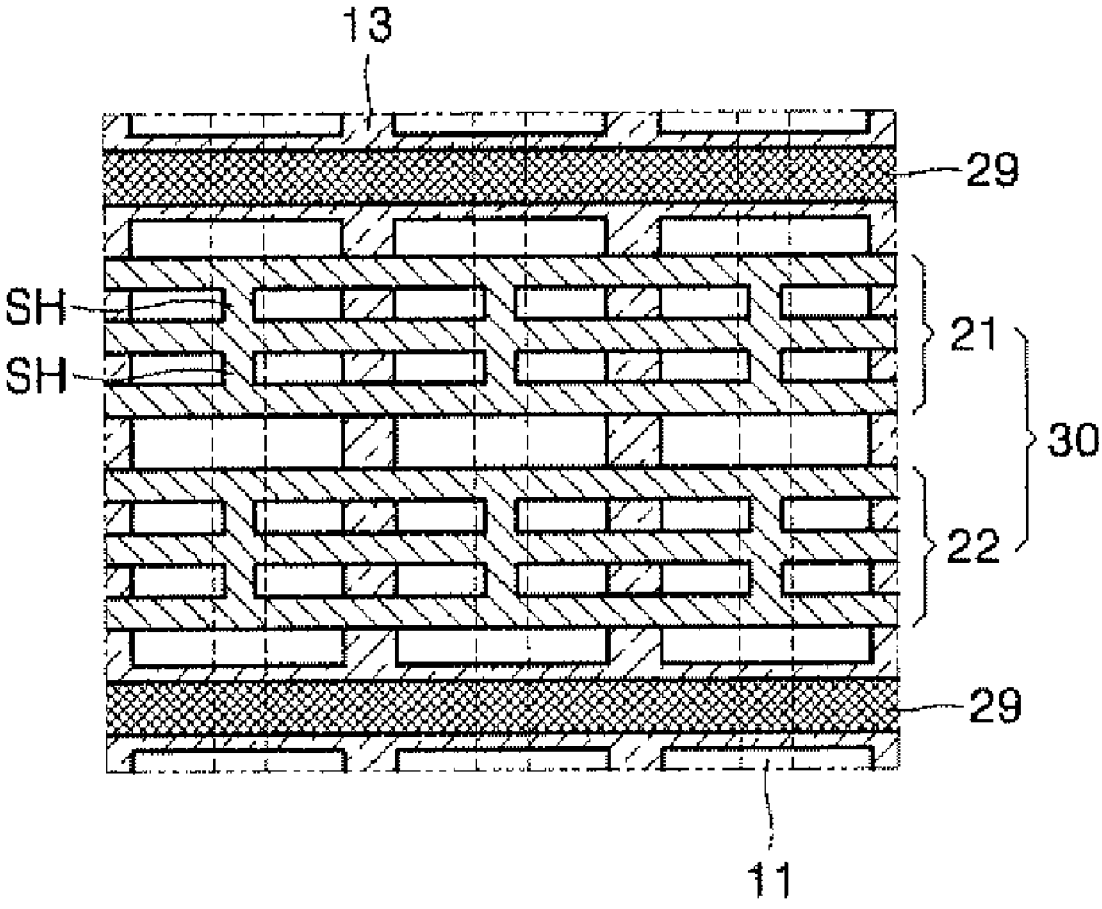
FIG. 3 is a front view of the AC plasma display panel of FIG. 1 viewed from a front glass substrate.

FIG. 1 is an exploded perspective view of a three-electrode surface discharge plasma display panel, as an example of an AC discharge display panel according to an exemplary embodiment of the present invention, FIG. 2 is an enlarged view of a part of an X electrode line or a Y electrode line of the display panel of FIG. 1, and FIG. 3 is a front view of the display panel of FIG. 1 from a position of a front glass substrate.

Referring to FIG. 1, FIG. 2, and FIG. 3, the AC plasma display panel includes a front substrate 20 and a rear substrate 10. The front and rear substrates 10 and 20 may be made of glass. Address electrode lines 11, front and rear dielectric layers 23 and 12, pairs of X and Y electrode lines 30, a phosphor layer 15, barrier ribs 13, conductive black stripes 29, and a protective layer 24 are arranged between the front and rear glass substrates 20 and 10.

The address electrode lines 11 are arranged on the rear glass substrate 10 and are covered by the rear dielectric layer 12. The barrier ribs 13 are arranged on the rear dielectric layer 12, and they define discharge regions 14 of the display cells and prevent cross talk from generating between neighboring cells. The phosphor layer 15 is applied on the display cells.

The pairs of X and Y electrode lines 30 are arranged on the front substrate 20 in a direction crossing the address electrode lines 11. The front dielectric layer 23 covers the X and Y electrode lines.

The X electrode line 21 and the Y electrode line 22 each include a plurality of openings. For example, one X electrode line 21 includes three auxiliary electrode lines and a short-circuit portion SH between the three auxiliary electrode lines. When a width $W_B$ of one auxiliary electrode line is in a range of 20 μm through 150 μm, a width $W_S$ of the short-circuit portion SH may be determined as follows.

$$0.2W_B \leqq W_S < W_B \quad (1)$$

The conductive black stripes 29 are arranged between, and parallel to, the pairs of X and Y electrode lines 30. The protective layer 24, which may be a magnesium oxide (MgO) layer, may be arranged on the front dielectric layer 23 to protect the panel from a strong electric field. A gas for forming plasma is sealed in the discharge regions 14.

In each pair of the X and Y electrode lines 30, the X electrode line 21 and the Y electrode line 22 each include a plurality of layers. The intermediate layer of the plurality of layers has the smallest resistivity, the outermost layers have the highest resistivity, and the layer(s) between the intermediate and outermost layers have increasing resistivity. For example, referring to the exemplary embodiment of FIG. 2, the X electrode line 21 and the Y electrode line 22 each include a plurality of layers L1 through L5. In this case, the intermediate layer L3 has the smallest resistivity, the second and fourth layers L2 and L4 have a resistivity that exceeds the resistivity of the intermediate layer L3, and the outermost layers L1 and L5 have a resistivity that exceeds the resistivity of the second and fourth layers L2 and L4.

For example, the resistivity of the intermediate layer L3 may be in a rage of $10^{-8}$ through $2\times10^{-8}\Omega\cdot$cm, the resistivity of the second and fourth layers L2 and L4 may be about 60Ω·cm, and the resistivity of the first and fifth layers L3 and L5 may be about $7\times10^{8}\Omega\cdot$cm. The third layer L3 is thicker than the total thickness of the remaining layers. Accordingly, an average resistance of the pairs of X and Y electrode lines 30 may be reduced.

For example, when the total thickness of the plural layers L1 through L5 is T, the thickness of the first and fifth layers L1 and L5 may be 0.05T, respectively, the thicknesses of the second and fourth layers L2 and L4 may be 0.1T, respectively, and the thickness of the third layer L3 may be 0.7T. The total thickness T of the plural layers L1 through L5 may be in a range of 0.1 through 10 μm.

The third layer L3 may be formed of a conductive material having a low resistivity, and the other layers may be formed of an oxide of the conductive material. For example, the third layer L3 may be formed of a metal, and the other layers may be formed of an oxide of the metal. In this case, the adhesive force between the first layers L1 of the X electrode line 21, the Y electrode line 22, and the conductive black stripe 29 and the front glass substrate 20 may be strengthened.

The third layer L3 may be made of Ag, Pt, Pd, Ni, or Cu. In the current embodiment, the third layer L3 comprises Ag, the first and fifth layers L1 and L5 comprise $Ag_2O$, and the second and fourth layers L2 and L4 comprise AgO or $Ag_2O_3$. A method of fabricating the plural layers L1 through L5 will be described with reference to FIG. 4.

The conductive black stripe 29 may also include a plurality of layers. An intermediate layer among the plural layers has the smallest resistivity, and the farther a layer is from the intermediate layer, the larger its resistivity.

Therefore, the layers outside the metal intermediate layer L3 among the plural layers L1 through L5 have larger resistivity and larger oxidation coupling force in the X electrode line 21, the Y electrode line 22, and the conductive black stripe 29, respectively. Accordingly, the conductive particles of the layer L3, which has small resistivity and small coupling force, have difficulty in diffusing and migrating to the front dielectric layer 23 through the other layers.

Additionally, since the resistivity of the plural layers L1 through L5 decreases toward the intermediate layer L3, the average resistance of each pair of the X and Y electrode lines 30 may be reduced. In other words, an average conductivity of the X and Y electrode line pairs 30 may increase.

Therefore, infiltration of conductive particles from the X and Y electrode line pairs 30 toward the front dielectric layer 23 may be prevented while maintaining the conductivity of the pairs of X and Y electrode lines 30. Additionally, diffusion and migration of conductive particles from the conductive black stripe 29 toward the front dielectric layer 23 may be prevented.

Figure 4:
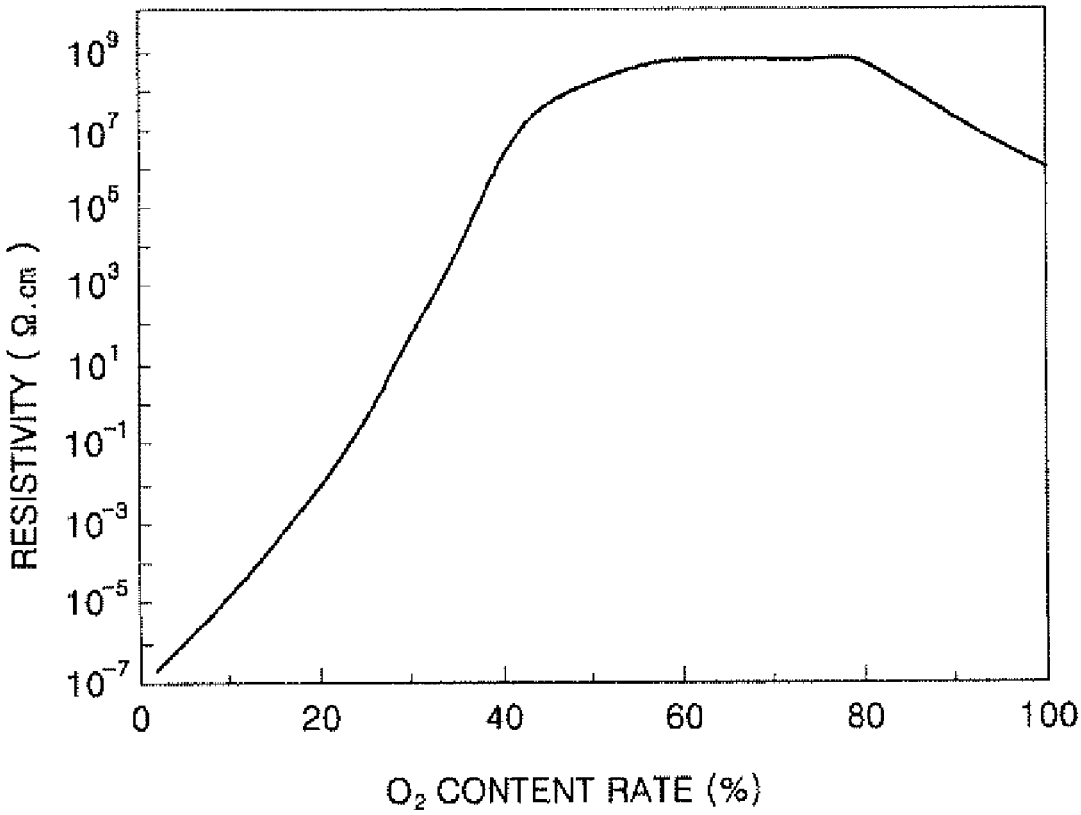
FIG. 4 is a graph of a resistivity of a thin film versus oxygen content rate of a gas, in a case where a pair of X and Y electrodes of FIG. 1 are formed using an Ag-sputtering thin film deposition method.

FIG. 4 illustrates layer resistivity versus an oxygen content rate in a gas when the pairs of the X and Y electrode lines are formed using an Ag-sputtering thin film deposition method. The gas used to deposit the Ag-sputtering thin film may be a mixture containing $O_2$ and Ar. Therefore, the oxygen content rate (%) is a rate occupied by $O_2$ in the gaseous mixture of $O_2$ and Ar.

Processes for forming the pairs of X and Y electrode lines 30 is described below with reference to FIG. 1, FIG. 2, and FIG. 4.

The first layer L1 may be formed of $Ag_2O$, which is a stably combined silver oxide, under an atmosphere where the oxygen content rate (%) is about 60~80% on a portion of the front substrate 20. The resistivity of the first layer L1 is about $7\times10^{8}\Omega\cdot$cm.

Additionally, the second layer L2 may be formed of AgO or $Ag_2O_3$, which is unstably formed silver oxide, under an atmosphere where the oxygen content rate (%) is about 30% on the first layer L1. The resistivity of the second layer L2 is about 60Ω·cm.

Next, air inducing is suspended, and the third layer L3 may be formed of Ag on the second layer L2. The resistivity of the third layer L3 is about $10^{-8}$~$2\times10^{-8}\Omega\cdot$cm.

Then, the oxygen content rate (%) of the gas is increased to about 30%, and the fourth layer L4 may be formed of the AgO or $Ag_2O_3$, which is unstably combined silver oxide, on the third layer L3. The resistivity of the fourth layer L4 is about 60Ω·cm.

Next, the oxygen content rate of the gas increases to 60~80%, and the fifth layer L5 may be formed of $Ag_2O$, which is stably combined silver oxide, on the fourth layer L4. The resistivity of the fifth layer L5 is about $7\times10^{8}\Omega\cdot$cm.

As described above, according to an AC plasma display panel of the present invention, when a layer among a plurality of layers in an electrode line is far from the intermediate layer, the resistivity of the layer increases, and thus, the coupling force of the layer increases. Accordingly, conductive particles from the layer having the small resistivity and the small coupling force may not diffuse and migrate to the dielectric layer through the other layers.

Additionally, when the layer is close to the intermediate layer, the resistivity decreases. Accordingly, the average resistance of the electrode lines may be reduced.

Therefore, according to exemplary embodiments of the present invention, the diffusion and migration of conductive particles to the dielectric layer from the electrode lines may be prevented while maintaining the high conductivity of the electrode lines.

It will be apparent to those skilled in the art that various modifications and variation can be made in the present invention without departing from the spirit or scope of the invention. Thus, it is intended that the present invention cover the modifications and variations of this invention provided they come within the scope of the appended claims and their equivalents.

What is claimed is:

1. An alternating current (AC) discharge display panel, comprising:

a plurality of electrode lines covered by a dielectric layer, wherein each electrode line comprises a plurality of layers, in which an intermediate layer has the smallest resistivity of the plurality of layers and the remaining layers have increasing resistivity in a direction away from the intermediate layer.

2. The display panel of claim 1, wherein the intermediate layer is thicker than the total thickness of the remaining layers.

3. The display panel of claim 1, wherein the intermediate layer comprises a conductive material, and the remaining layers comprise an oxide of the conductive material.

4. The display panel of claim 3, wherein the intermediate layer comprises a metal, and the remaining layers comprise an oxide of the metal.

5. The display panel of claim 1, wherein:

each electrode line sequentially comprises a first layer, a second layer, a third layer, a fourth layer, and a fifth layer, the third layer has a first resistivity, the second layer and the fourth layer have a second resistivity, which is larger than the first resistivity, and the first layer and the fifth layer have a third resistivity, which is larger than the second resistivity.

6. The display panel of claim 5, wherein the third layer comprises Ag, and the first layer and the fifth layer comprise $Ag_2O$.

7. An alternating current (AC) discharge display panel, comprising:

pairs of X electrode lines and Y electrode lines covered by a first dielectric layer adjacent to a first substrate; and address electrode lines covered by a second dielectric layer adjacent to a second substrate, wherein the X electrode lines and the Y electrode lines each include a plurality of layers, in which an intermediate layer has the smallest resistivity of the plurality of layers and the remaining layers have increasing resistivity in a direction away from the intermediate layer.

8. The display panel of claim 7, wherein the X electrode lines and the Y electrode lines are arranged substantially in parallel to each other.

9. The display panel of claim 8, wherein the X electrode line and the Y electrode line each include a plurality of layers, and layers of the plurality of layers have increasing resistivity in a direction from the intermediate layer to the first substrate.

10. The display panel of claim 8, wherein the X electrode line and the Y electrode line each include a plurality of layers, and layers of the plurality of layers have increasing resistivity in a direction from the intermediate layer to the first dielectric layer.

11. The display panel of claim 9, wherein the X electrode line and the Y electrode line each include a plurality of openings.

12. The display panel of claim 7, further comprising:

a conductive black stripe arranged between and substantially in parallel to the pairs of X electrode lines and Y electrode lines, wherein the conductive black stripe comprises a plurality of layers, in which an intermediate layer has the smallest resistivity of the plurality of layers and the remaining layers have increasing resistivity in a direction away from the intermediate layer.

13. An alternating current (AC) discharge display panel, comprising:

a plurality of electrode lines protected by a dielectric layer, wherein each of the electrode lines comprises a plurality of layers comprising an intermediate layer, a first outermost layer, and a second outermost layer, and wherein the intermediate layer has the smallest resistivity of the plurality of layers, and the first outermost layer and the second outermost layer have the highest resistivity of the plurality of layers.

14. The display panel of claim 13, wherein the first outermost layer and the second outermost layer have the same resistivity.

15. The display panel of claim 14, wherein the resistivity of layers increases in a direction from the intermediate layer to the first outermost layer and in a direction from the intermediate layer to the second outermost layer.

16. The display panel of claim 15, wherein the intermediate layer is thicker than the total thickness of all other layers.

17. The display panel of claim 13, wherein the intermediate layer comprises a conductive material, and the first outermost layer and the second outermost layer comprise an oxide of the conductive material.

* * * * *